US006302747B1

(12) United States Patent
Bui et al.

(10) Patent No.: US 6,302,747 B1
(45) Date of Patent: Oct. 16, 2001

(54) TWO-POSITION (ON-OFF) ACTUATOR WITH MODULAR CONNECTOR

(75) Inventors: Tanh M. Bui, Cary; David W. Rawls, Raleigh, both of NC (US)

(73) Assignee: Buehler Products, Inc., Cary, NC (US)

( * ) Notice: Subject to any disclaimer, the term of this patent is extended or adjusted under 35 U.S.C. 154(b) by 0 days.

(21) Appl. No.: 09/562,007

(22) Filed: May 2, 2000

(51) Int. Cl.[7] ..... H01R 13/405
(52) U.S. Cl. ..... 439/736; 439/620
(58) Field of Search ..... 439/736, 544, 439/571, 545, 552, 620

(56) References Cited

U.S. PATENT DOCUMENTS

| | | | | |
|---|---|---|---|---|
| 4,225,209 | | 9/1980 | Hughes | 339/126 |
| 4,648,682 | | 3/1987 | Tubbs | 339/154 |
| 4,850,899 | | 7/1989 | Maynard | 439/628 |
| 4,913,114 | | 4/1990 | Kalippke et al. | 123/339 |
| 4,978,313 | * | 12/1990 | Kameyama et al. | 439/248 |
| 5,137,255 | | 8/1992 | Sumida et al. | 251/77 |
| 5,190,460 | | 3/1993 | Emani | 439/51 |
| 5,240,536 | * | 8/1993 | Bradley et al. | 439/654 |
| 5,296,315 | | 3/1994 | Rein | 429/100 |
| 5,395,264 | | 3/1995 | Keith | 439/502 |
| 5,405,271 | | 4/1995 | Bauer et al. | 439/480 |
| 5,417,083 | | 5/1995 | Eber | 62/528 |
| 5,532,534 | | 7/1996 | Baker et al. | 310/89 |
| 5,547,399 | | 8/1996 | Naghi et al. | 439/623 |
| 5,554,901 | | 9/1996 | Wendel et al. | 310/162 |
| 5,565,720 | | 10/1996 | Janisse et al. | 310/68 |
| 5,605,129 | | 2/1997 | Strombeck et al. | 123/361 |
| 5,718,259 | | 2/1998 | Miyake et al. | 137/338 |
| 5,846,100 | * | 12/1998 | Ogawa | 439/736 |
| 5,855,064 | | 1/1999 | Chang | 29/861 |
| 5,857,617 | | 1/1999 | Weng | 236/49.3 |
| 5,926,952 | * | 7/1999 | Ito | 29/883 |
| 5,934,644 | | 8/1999 | Boillat et al. | 251/129.11 |
| 5,961,207 | | 10/1999 | Petkovic | 362/376 |
| 5,984,695 | | 11/1999 | Riehl et al. | 439/76.1 |
| 5,996,554 | | 12/1999 | Tojo et al. | 123/399 |

* cited by examiner

*Primary Examiner*—Gary Paumen
*Assistant Examiner*—Ross Gushi
(74) *Attorney, Agent, or Firm*—Jacobson Holman, PLLC

(57) ABSTRACT

An actuator housing provides a low-cost method of achieving electrical connection to the motor terminals of a DC motor in a two position HVAC actuator. The connector configuration interfacing with a controller or power supply is easily changed by making the connector a modular connector, providing an effective fluid ingress prevention. The modular connector design is fixed from the connector flange inward into a housing, and is flexible outward with respect to its pin configuration and shroud shape. This design allows different connector configurations to be utilized with minimal tooling investment. A capacitor can also be inserted and crimped to the connector pin stampings, prior to being over-molded, to provide EMI filtering.

5 Claims, 3 Drawing Sheets

TWO-POSITION (ON-OFF) ACTUATOR WITH MODULAR CONNECTOR

FIELD OF THE INVENTION

The present invention relates to a two position, on-off heating, ventilation and air conditioning (HVAC) electric actuator for the automotive industry, which includes a DC motor and gear train to produce correct speed-torque characteristics, and a modular connector to interface with a controller or power supply.

BACKGROUND OF THE INVENTION

Two-position (on-off) HVAC actuators are typically controlled by directly applying power to a drive motor. The actuators commonly use soldered leads, printed circuit boards, conductor stampings, or a combination to make connection between the motor terminals and the output connector.

The polarity of the applied power determines the direction of actuator rotation. The necessary electrical connection requires two conductive paths, connecting the two connector pins to two motor terminals. The actuator housing also typically forms the shroud for the connector around the connector pins.

The electrical connection is usually achieved via one of the following designs approaches:

1. Printed circuit board (PCB): a PCB is used to mount a pair of connector pins. Copper traces are screened onto the board, leading to two copper pads where motor terminals are attached (soldered). The motor is then electrically connected to these two terminals via lead wires, or directly.
2. Conductor stampings: two stampings are formed into the shape of a connector pin on one end, and motor terminal on the other end. These stampings are mechanically secured into the plastic actuator housing.
3. Flying leads: insulated lead wires are soldered onto the motor, and terminated with a connector. Lead wires are captured by the two halves of the actuator housing.

In FIG. 1, an example of a lower housing section 10 of an actuator housing is shown. A connector shroud 12 is integral with the housing section 10 and leads into the interior 14 of the housing actuator. A printed circuit board 16 is shown which fits into the lower housing section 10 such that two connector pins 18*a,* 18*b* project into the connector shroud 12.

A free end of the connector pins forms the electrical connection between a controller or a power supply inserted into the shroud 12. The opposite ends of the connector pins are welded to the underside of the PCB 16.

The connector pins are electrically connected to two trifurcated terminals 20*a,* 20*b* by copper connectors screened to the underside of the PCB. The terminals 20*a,* 20*b* are also welded at a free end on the underside of the PCB.

Optionally a capacitor can be secured to the underside of the PCB and be electrically connected between the terminals and the connector pins. The capacitor is commonly employed to reduce electromagnetic interference (EMI).

Interior 14 of the lower housing section 10 is exposed through the connector shroud 12. This communication may allow entry of fluid to the actuator housing, and thereby potentially adversely affect the workings of the housing actuator.

The PCB and the other design approaches are expensive and exhibit weaknesses, ranging from allowing fluid ingress to the difficulty in adding additional components, such as a capacitor across the motor terminals.

SUMMARY OF THE INVENTION

Accordingly, it is an object of the present invention to provide a low-cost method of achieving electrical connection to the motor terminals of a DC motor in a two position HVAC actuator. The invention allows the flexibility of easily changing the connector configuration interfacing with a controller or power supply by making the connector a modular connector, providing effective fluid ingress prevention.

The modular connector design is fixed from the connector flange inward into a housing, and is flexible outward with respect to its pin configuration and shroud shape. This design allows different connector configurations to be utilized with minimal tooling investment. A capacitor can also be inserted and crimped to the connector pin stampings, prior to being over-molded, to provide additional EMI filtering.

The modular connector of the present invention is made up of two conductor stampings. Each conductor stamping includes a trifurcated terminal and a connector pin/blade. Two conductor stampings interconnected by a bridge are insert molded into a specified connector shroud configuration. After molding, the bridge is severed from the conductor stampings externally of the over molded connector.

The modular connector is positioned in a housing for a HVAC actuator so that the DC motor terminals are pressed into the two trifurcated terminals of the conductor stampings, now molded into the connector, making positive and ground connections. The connector placement/position leaves the connection shroud portion exposed in the final actuator assembly for easy connection with customer wiring. This concept also allows alternate customer connector wiring configurations to be made without actuator housing modifications. A molded-in capacitor can be added for EMI protection, if required by the customer.

The configuration of the upper and lower housing portions of the actuator housing includes a groove into which a flange of the connector shroud is placed. The cooperation of the flange of the connector shroud and the groove in the housing sections prevents ingress of fluid into the housing. The over molded modular connector only has the connector shroud projecting from the housing.

The female portion of the connector shroud receives a male connector interface with a controller or power supply for the actuator. The shroud houses two connector pins for making the connection with the controller or power supply. The configuration of the connector shroud is easily changed to accommodate individual customer shapes for a controller or power supply. The configuration of an elongated rail portion of the modular connector containing the two trifurcated terminals is maintained with constant dimensions even when changing the shroud configuration so as to cooperate with the terminal blades of a DC motor located within the actuator housing.

Accordingly, it is another object of the present invention to form a modular connector for an actuator of an HVAC actuator by over molding two metal stampings, each including a connector pin and a trifurcated terminal so as to form a connector shroud having a flange which cooperates with a groove in upper and lower housing sections of an actuator housing.

It is still another object of the present invention to provide a modular connector for placement in a groove defined between upper and lower housing sections of an actuator housing with the configuration of a connector shroud being changeable to accommodate different controllers or power supply configurations which cooperate with the connector shroud to control a motor contained in the actuator housing.

It is still yet another object of the present invention to form a modular connector having a connector shroud with a flange which cooperates with a groove in the upper and lower housing sections of an actuator housing so as to prevent ingress of fluid into the actuator housing.

It is still yet another object of the present invention to provide a modular connector cooperating internally of an actuator housing with a DC motor and having a connector shroud projecting from the actuator housing and including a flange for cooperating with the housing to prevent fluid ingress, with the connector shroud cooperating with a controller or power supply connection for the DC motor.

It is still another object of the present invention to provide a modular connector formed by over molding two stampings each having a connector pin and a trifurcated terminal with the two stampings interconnected by a bridge which is severed from the stampings after the over molding process.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
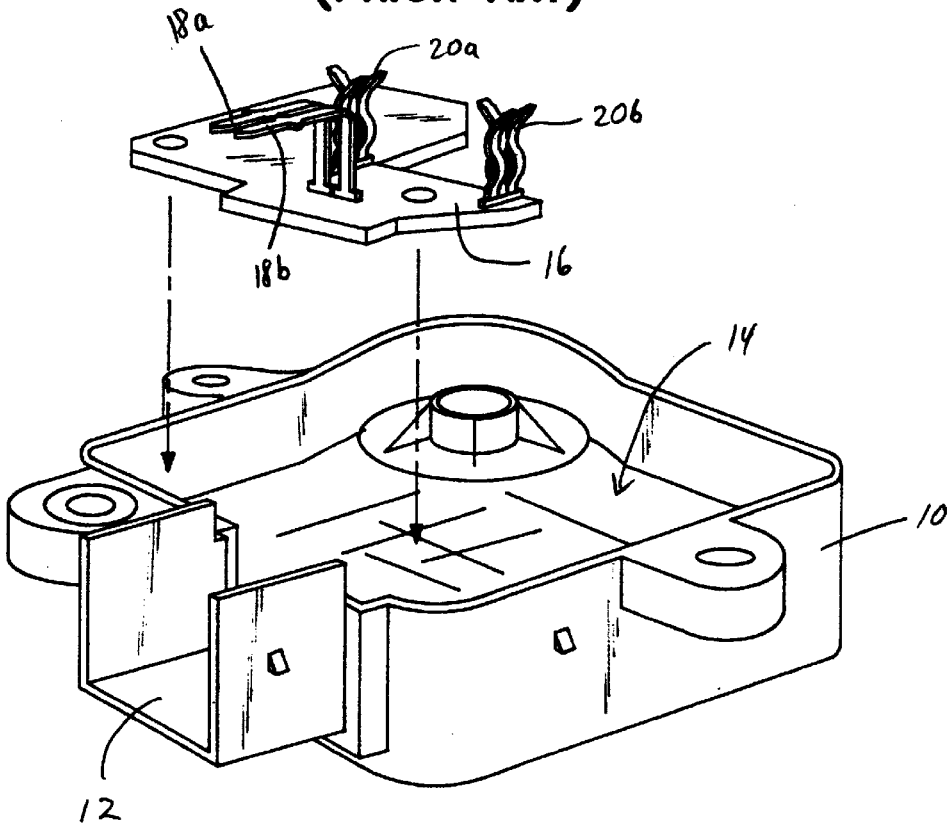
FIG. 1 (PRIOR ART)
FIG. 1 is an exploded view of a known assembly including a lower housing section and a printed circuit board connector having two connector pins soldered to the PCB and two trifurcated terminals soldered to the PCB with the connector pins and trifurcated terminals being electrically interconnected by screened copper conductors.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
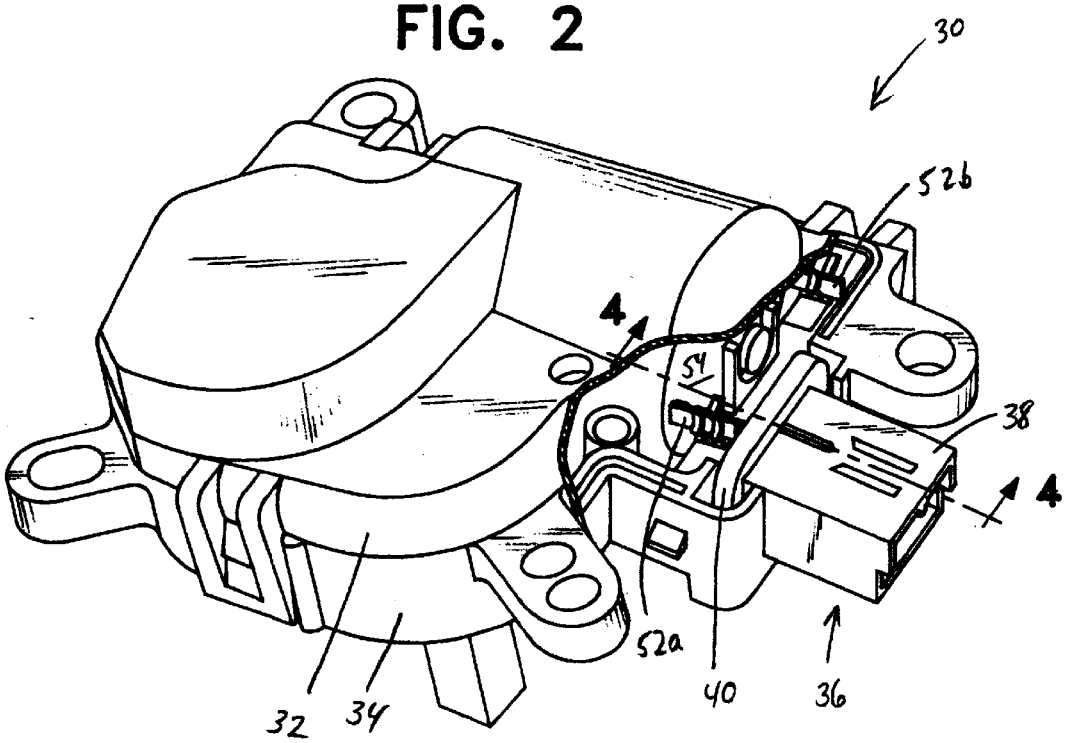
FIG. 2 is a perspective, partial sectional view of an actuator housing including the modular connector of the present invention mounted in the housing so as to prevent fluid ingress and to align two trifurcated terminals of the modular connector with the terminal blades of a DC motor.
Figure 3:
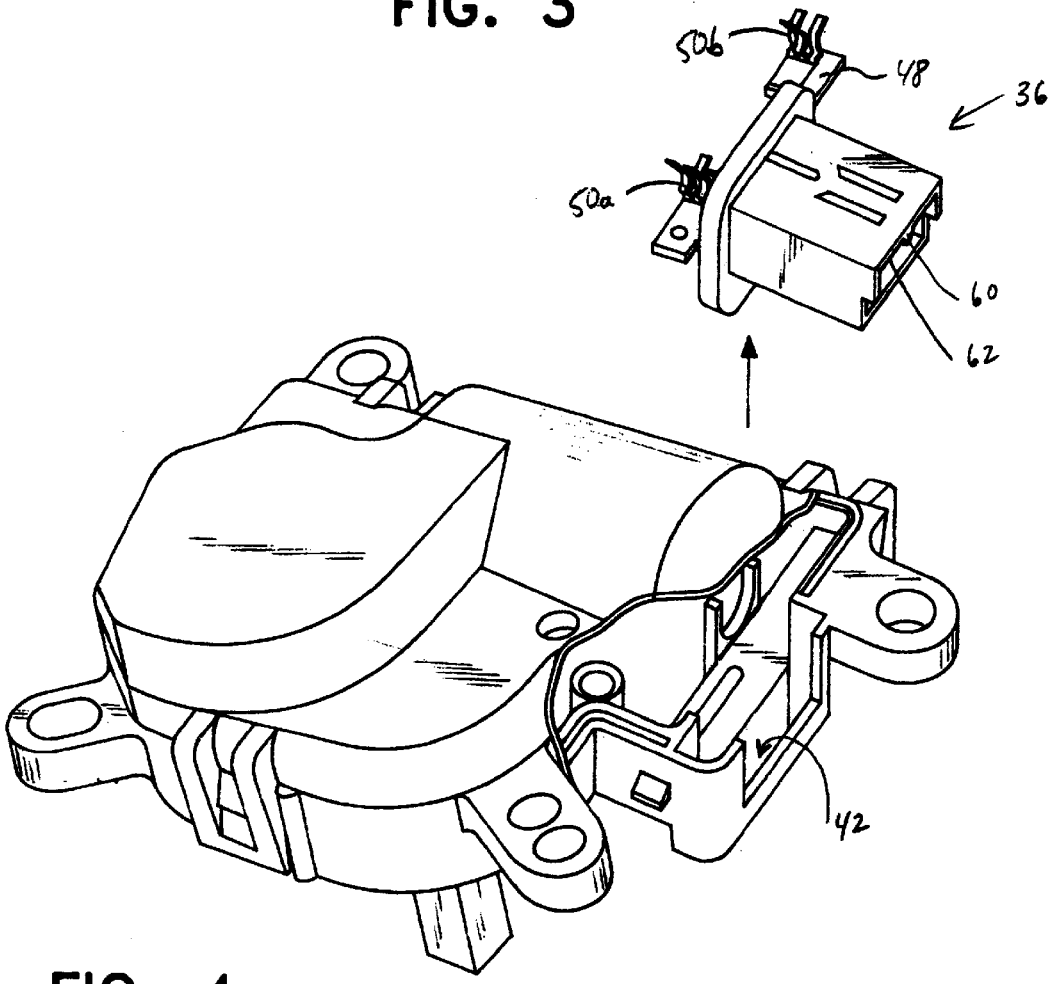
FIG. 3 is an exploded view of the actuator housing of the present invention, shown partially in section, and the modular connector spaced from the actuator housing.
Figure 4:
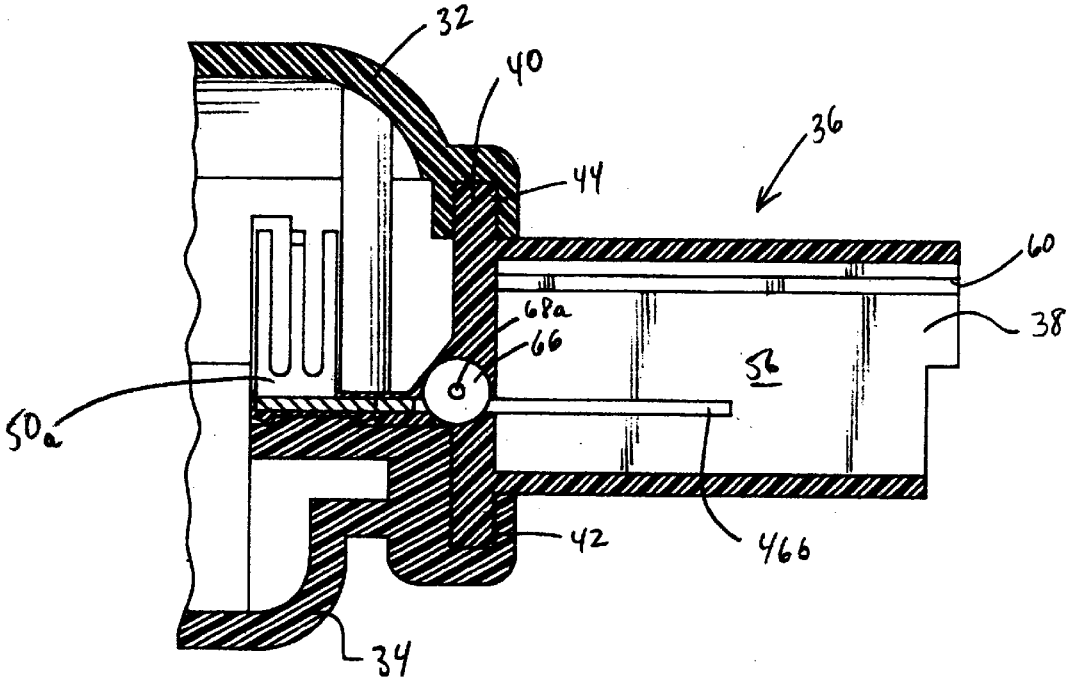
FIG. 4 is a cross sectional view taken along line 4—4 of FIG. 2.

With reference to the drawings, in general, and to FIGS. 2 through 4, in particular, a two position actuator with modular connector according to the teachings of the present invention is generally designated as 30. With reference to is orientation in FIG. 2, the actuator includes an upper housing section 32 and a lower housing section 34. Located between the two housing sections is a modular connector 36. The modular connector includes a connector shroud 38 and a connector flange 40.

As shown in FIGS. 3 and 4, lower housing section 34 includes a groove 42 for receipt of the flange 40. Similarly, upper housing section 32 includes a groove 44 for receipt of the flange 40. The flange 40 is solid except for the projection therethrough of two connector pins 46*a,* 46*b*. Accordingly, with the flange 40 located in the grooves 42, 44 the shroud 38 projects from the housing sections while blocking an opening into the housing sections so as to prevent ingress of fluid past the connector 36.

Located on the opposite side of the flange 40 from the shroud 38, is an elongated rail portion 48. Rail portion 48 includes two trifurcated terminals 50*a,* 50*b* which project upwardly from the rail portion 48. The trifurcated terminals 50*a,* 50*b* are positioned on the rail 48 to be aligned with terminal blades 52*a,* 52*b* of a DC motor 54. Each respective trifurcated terminal 50*a,* 50*b* is an extension of connector pins 46*a,* 46*b* so that when a male controller or power supply is inserted into the interior 56 of the shroud 38, electrical connection is made with the terminals 50*a,* 50*b* through the connector pins 46*a,* 46*b* for control or energization of the motor 54 and its output shaft 58.

Secured on the output shaft 58 is a worm gear 60 for interconnection with a gear assembly. The gear assembly rotates a shaft projecting through an opening 62 in lower housing section 34 to drive a HVAC system component.

Figure 5:
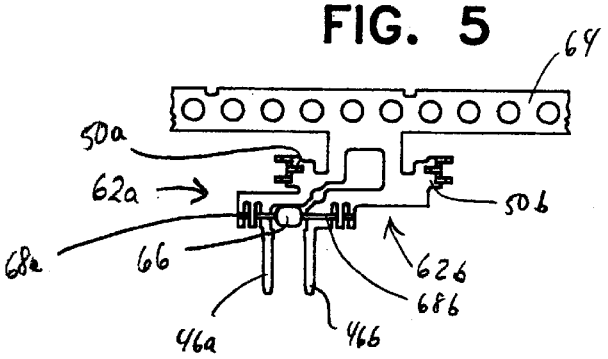
FIG. 5 is a plan view of two metal stampings, each including a connector pin and a trifurcated terminal which are interconnected by a metal bridge and also electrically interconnected by a capacitor.
Figure 6:
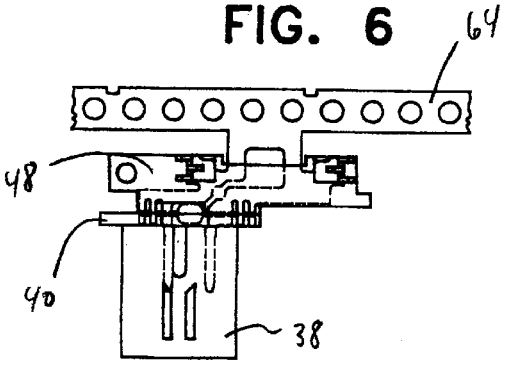
FIG. 6 is a plan view of the two stampings shown in FIG. 5 which have been placed in a mold and over molded by a plastic material to form a modular connector.
Figure 7:
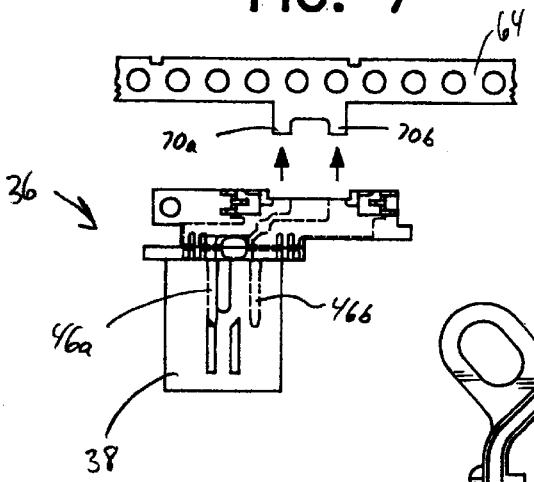
FIG. 7 illustrates the separation of the bridge from the two stampings so as to release the modular connector from the bridge with the two stampings secured in position within the over molded plastic connector.
Figure 8:
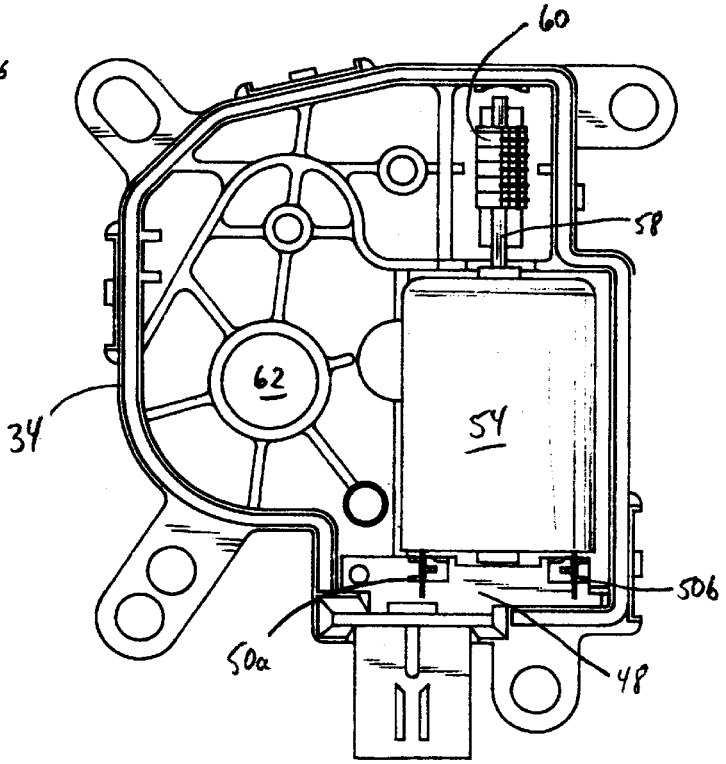
FIG. 8 is a plan view of the lower actuator housing section with the modular connector in place having a connector shroud projecting from the housing and a connector shroud flange mounted in a groove of the housing section so as to align the two trifurcated terminals of an elongated rail portion with the terminal blades of a DC motor.

In the manufacture of the modular connector of the present invention, as shown in FIGS. 5 through 7, initially, two conductive metal stampings 62*a,* 62*b* are interconnected by an elongated bridge member 64. Each stamping includes a connector pin 46*a,* 46*b* and a trifurcated terminal 50*a,* 50*b,* respectively. Optionally located between the two bridge stampings is a capacitor 66 having wire portions 68*a,* 68*b* interengaged with the stampings 62*a,* 62*b*. The capacitor 66 helps reduce EMI.

Bridge member 64 is used to hold the two stampings 62*a,* 62*b* in a mold where portions of the stampings are molded in a non-conductive material, such as plastic, as shown in FIG. 6. The molded connector includes connector shroud 38, flange 40 and elongated rail portion 48.

After molding, the bridge member 64 is severed from the modular connector 36 by cutting two leg portions 70*a,* 70*b*. The finished modular connector 36 is then ready to be inserted between two housing sections of an actuator.

According to the interface provided by a customer to connect a controller or power supply to the modular connector, the shroud portion 38 may be molded in a different configuration from that shown in the drawings. The flange 40 and elongated rail portion 48 remain in the same configuration so as to cooperate with the positioning of the motor 54 and the grooves 42, 44 in the respective housing sections. The shroud may be changed so that, for example, as shown in FIGS. 3 and 4, a downwardly projecting element

60 extends from an upper surface 62 of the interior of the shroud 38. This projection is provided to cooperate with a specialized shape of a customer controller or power source.

The shroud configuration may be altered to provide a specialized actuator which cooperates with the design of the customer's controller or power source while still providing the fluid sealing advantages provided by the flange located in grooved portions of the housing sections. This makes the actuator of the present invention particularly desirable from a manufacturing cost perspective.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A modular connector comprising:

two electrically conductive stampings each including a connector pin for connection with a controller or power source and a terminal for connection with a terminal blade of a motor, said two conductive stampings being encased in a non-conductive material forming a connector shroud having a connector shroud flange and a rail portion with said connector shroud flange being located between said connector shroud and said rail portion, said connector pin of each of said two stampings projecting into said connector shroud and said terminal of each of said two stampings projecting from said rail portion, and a capacitor interconnecting said two stampings, said capacitor including laterally extending wires to interconnect with said two stampings, said capacitor and said wires being also encased in said non-conductive material.

2. A modular connector as claimed in claim 1, wherein said rail portion extends laterally with respect to one side of said connector shroud and said connector shroud flange.

3. A modular connector as claimed in claim 1, wherein said terminals of said two stampings are trifurcated.

4. A modular connector as claimed in claim 1, wherein an interior of said connector shroud is blocked from communication with said rail portion by said connector shroud flange.

5. A modular connector as claimed in claim 4, wherein said interior of said connector shroud has at least one projection.

* * * * *